US008823224B2

(12) United States Patent
Schreiber

(10) Patent No.: US 8,823,224 B2
(45) Date of Patent: Sep. 2, 2014

(54) FAN, ELECTRIC MOTOR, AND MACHINE TOOL

(75) Inventor: Wolfgang Schreiber, Jengen (DE)

(73) Assignee: Hilti Aktiengesellschaft, Schaan (LI)

( * ) Notice: Subject to any disclaimer, the term of this patent is extended or adjusted under 35 U.S.C. 154(b) by 516 days.

(21) Appl. No.: 13/154,867

(22) Filed: Jun. 7, 2011

(65) Prior Publication Data

US 2011/0304230 A1 Dec. 15, 2011

(30) Foreign Application Priority Data

Jun. 8, 2010 (DE) ..... 10 2010 029 779

(51) Int. Cl.
*H02K 9/06* (2006.01)
*H02K 5/06* (2006.01)

(52) U.S. Cl.
USPC ..... 310/63; 310/60 R; 310/417

(58) Field of Classification Search
USPC ..... 310/62–63, 60 R, 417
See application file for complete search history.

(56) References Cited

U.S. PATENT DOCUMENTS

| | | | | | |
|---|---|---|---|---|---|
| 923,673 | A * | 6/1909 | Lord | 310/63 |
| 2,604,501 | A * | 7/1952 | Wightman | 310/63 |
| 2,809,307 | A * | 10/1957 | Penney et al. | 310/60 R |
| 3,454,978 | A | 7/1969 | Kuwahara | |
| 3,648,086 | A * | 3/1972 | Renner et al. | 310/63 |
| 3,749,953 | A * | 7/1973 | Baumann et al. | 310/62 |
| 4,275,321 | A * | 6/1981 | Shimamoto et al. | 310/59 |
| 5,088,362 | A * | 2/1992 | Schalles | 82/142 |
| 5,311,089 | A | 5/1994 | Stroetgen et al. | |
| 7,157,818 | B2 * | 1/2007 | Jones | 310/63 |
| 7,166,939 | B2 * | 1/2007 | Voigt et al. | 310/47 |
| 7,355,316 | B2 * | 4/2008 | Yokota et al. | 310/417 |
| 7,372,180 | B2 | 5/2008 | Burger et al. | |

FOREIGN PATENT DOCUMENTS

| | | | |
|---|---|---|---|
| DE | 4220078 | A1 | 12/1993 |
| DE | 0671244 | A1 | 9/1995 |
| DE | 69409326 | T2 | 11/1998 |
| DE | 10349205 | A1 | 6/2005 |
| EP | 0651161 | A1 | 5/1995 |

OTHER PUBLICATIONS

DE Communication, Feb. 22, 2011, 3 pages.

* cited by examiner

*Primary Examiner* — Burton Mullins
(74) *Attorney, Agent, or Firm* — McAndrews, Held & Malloy, Ltd.

(57) ABSTRACT

A fan having an air guide and a flywheel is provided, the flywheel being attached to a shaft, for cooling an electric motor. The electric motor has a rotor which can be attached to the shaft. The air guide is arranged in an interchangeable manner at a position between the flywheel and the rotor with respect to the axial direction, and has an air guide opening with an inner cross section for the purpose of forming a blowing channel. An air flow generated by the flywheel can be guided through the blowing channel in the axial direction. The inner cross section is smaller than an outer cross section of the rotor.

10 Claims, 3 Drawing Sheets

FAN, ELECTRIC MOTOR, AND MACHINE TOOL

RELATED APPLICATIONS

The present application claims priority to German Patent Application DE 10 2010 029 779.8, filed Jun. 8, 2010, and entitled "Fan, Electric Motor, and Machine Tool" the entire content of which is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The invention relates to a fan having an air guide and a fan wheel, the same being attached to a shaft, for the purpose of cooling an electric motor. The electric motor has a rotor which can be attached to the shaft. The air guide is arranged in an exchangeable manner at a position between the flywheel and the rotor with respect to the axial direction, and has an air guide opening with an inner cross section for the purpose of forming a blowing channel. An air flow which can be generated by the flywheel can be guided through the blowing channel in the axial direction. The invention also relates to an electric motor, having a stator and a rotor attached to a shaft, and having a fan with an air guide and with a flywheel attached to said shaft for the purpose of cooling the electric motor. The invention also relates to a machine tool having an electric motor, and to a method for the production of the electric motor.

PRIOR ART

A fan and an electric motor of the type named above are mounted on the same shaft, meaning that the flywheel is also attached to the shaft which rotates with the rotor of the electric motor. To complete the system made up of an electric motor and a fan, the fan is provided with an air guide, and the same should be attached to the assembly component made up of, at least, the shaft, rotor, and flywheel. As such, the air guide is arranged in a preferably interchangeable manner at a position between the flywheel and the rotor with respect to the axial direction. In certain previously known designs, the air guide was mounted on the assembly component made up of the shaft, rotor, and flywheel through the air guide opening of the air guide. For this purpose, an inner cross section of the air guide opening is chosen which is larger than an outer cross section of the rotor, particularly of the rotor pack. A minimum diameter of the inner cross section of the air guide opening is consequently determined by the outer diameter of the rotor, particularly of the rotor pack. Otherwise, it would previously have been impossible to mount the air guide on the assembly component made up of the shaft, flywheel, and rotor, particularly the rotor pack. This solution, which is very advantageous in itself for the manufacturing process, limits a further functional design of the air guide opening. It would be desirable to select an inner cross section for the air guide opening in the air guide, wherein said inner cross section is especially well suited to an improved design of a blowing channel, such that an air flow which is generated by the flywheel can be guided in the axial direction in an improved manner.

BRIEF SUMMARY OF THE INVENTION

Aspects of the present invention are provided in the context of this prior art, and address the problem of providing a fan, an electric motor having a production process, and a machine tool, wherein the electric motor can be cooled by air, by means of the fan, in an improved manner. Particularly, it should be possible to blow air over a rotor, particularly a rotor pack, in an improved manner by means of an air flow which can be generated by means of a flywheel. Particularly, an inner cross section of an air guide opening may be designed in an improved manner to form a blowing channel, in order to enable the provision of an improved air flow onto the rotor in the axial direction. Also, it should be possible to mount the air guide on the assembly component which is formed at least by the rotor, shaft, and flywheel.

The problem with respect to the fan is addressed by aspects of the present invention by means of a fan of the type discussed above, wherein according to aspects of the present invention, the inner cross section of the air guide opening in the air guide is smaller than an outer cross section of the rotor.

Aspects of the present invention are based on the realization that an increase in the performance of the fan can be achieved primarily by means of reducing the inner cross section of the air guide opening. In this way, a blowing channel is formed which has a cross section which is smaller than an outer diameter of the rotor. In this manner, it is possible to achieve an increased acceleration of the air flow which can be generated by the flywheel, such that cooling air can be guided onto the electric motor—especially onto the rotor and particularly the rotor pack—the cooling air having a higher velocity. The concept of aspects of the present invention can be realized without a need to increase the outer diameter of the flywheel and, along with it, the construction space of the fan.

Moreover, in a particularly preferred conFIG.uration, in order to enable a comparatively simple production and especially an exchangeable arrangement of the air guide at a position between the flywheel and the rotor with respect to the axial direction, in a particularly preferred manner, the air guide is designed as a part having at least two pieces assembled together, such that said part has at least a first and a second part. Development of this conFIG.uration has shown that it is particularly advantageous that the first and the second parts abut each other along a boundary line which transects the inner cross section of the air guide opening. As a result, the air guide can be mounted onto an assembly component made up of the shaft, rotor, and flywheel by putting the first and the second parts together, while preserving the advantageous design of the blowing channel according to aspects of the inventive concepts. Particularly, the first and second parts have a boundary edge running substantially along a boundary line which transects the inner cross section of the air guide opening. In other words, a first and a second part have a substantially curved body when viewed from above. Said body has a recess on the inner side thereof, which is determined by a part of the inner cross section of the air guide opening. The first and the second parts consequently can be brought into contact with the assembly component, the same being made up of the shaft, rotor, and flywheel, from the side—and already at the correct axial position between the flywheel and rotor—and then attached to the assembly component. Then the first and second parts can be put together at the correct axial position to form the air guide.

The concept of aspects of the present invention provide a production method, by means of which it is possible to produce an electric motor having a stator and a rotor which is attached to a shaft, and having a fan with an air guide and with a flywheel attached to the shaft for the purpose of cooling the electric motor. The method achieves the advantages with respect to fluid dynamics and manufacturing indicated above.

Problems addressed by aspects of the present invention with respect to the electric motor are solved by means of an electric motor of the type described above, the same including the additional features discussed above as well as below in connection with certain embodiments of the present invention.

Aspects of the invention leads to a machine tool having an electric motor of the type discussed above, including the additional features discussed above as well as below in connection with certain embodiments of the present invention.

Additional advantageous effects of aspects of the present invention are included, for example, in the dependent claims, and provide individual advantageous possibilities for realizing aspects of the concepts explained above, both with regards to the problems addressed by aspects of the present invention and to additional advantages.

The boundary line which transects the inner cross section of the air guide opening, wherein the first and the second part of the air guide abut each other at the boundary line, preferably runs along a diameter of the inner cross section. In this way, a relatively large lateral recess is created in a substantially curved body of a part, in a preferred manner. In this way, the first and second parts can be attached to an assembly component made up of a shaft, rotor and flywheel, then put together to form an air guide, in a comparatively simple manner and with a high freedom of movement. Moreover, it is possible in principle for the boundary line to run along a secant of the inner cross section. In principle, it is also possible to provide more than two parts which are put together to make the air guide. A boundary line which runs in the area transecting the inner cross section is preferably longer than a diameter of the shaft. Consequently, either part of the air guide can form a sufficient air guide opening, and the shaft can be guided through said air guide opening without needing to be narrowed in the section thereof from the rotor area to the air guide area.

A blowing channel formed by the air guide can preferably be characterized by a blow parameter which is the product of an inner diameter of the inner cross section of the air guide opening in the air guide and a free gap between the air guide and the flywheel. A boundary parameter can be advantageously formed as the product of an outer diameter of the rotor and a prespecified minimum free gap between the air guide and the flywheel. The minimum free gap has a value larger than zero; it has been demonstrated that the flywheel can only be brought as close to the air guide as a certain distance. In a particularly preferred conFIG.uration, the blow parameter is smaller or equal to the boundary parameter. Finally, it is possible to achieve a comparatively high accelerated cooling air in an air flow by means of selecting a comparatively small inner cross section of the air guide opening in the air guide, as is suggested according to the concept of aspects of the present invention. Moreover, however, an acceleration of the cooling air can be achieved by means of reducing a free gap between the air guide and the flywheel. Previously, both setting parameters (inner diameter and free gap as named above) were bounded by the outer diameter of the rotor and by the prespecified minimal free gap between the air guide and the flywheel. According to the concept of aspects of the present invention, the inner diameter of the inner cross section of the air guide opening can be comparatively significantly reduced, such that a gap between the air guide and the flywheel can be selected to be larger than the minimum prespecified free gap, if necessary. This can be exploited to create a comparatively advantageous air guide in the fan, and also confer an advantage on the performance of the fan in other ways. However, overall, the conFIG.uration allows a large free gap between the air guide and flywheel due to a significant reduction in the inner cross section of the air guide opening. However, it is possible to achieve an air flow in the blowing channel which has good characteristics and comparatively high cooling performance.

The first and the second parts may be advantageously connected to each other via a pinned joint. The parts can then be installed in a comparatively simple manner, and the air guide can be produced in a comparatively simple manner. A pin is designed in a spring-loaded manner in a particularly advantageous manner, and has a catch. The catch, which is preferably formed on a free end section of the pin, can be advantageously snapped into place in a recess which is shaped to receive the catch. Advantageously, a first part has a pin, and a second part has a recess in which the pin fits, particularly in which the catch fits. In principle, the pins and the recesses can be distributed depending on requirements on the at least first and second part, in an advantageous manner. In a particularly preferred manner, a first part has a first and second pin. Preferably, a second part has a first and a second recess, wherein one of the pin catches can be snapped into each said recess.

A pin catch is preferably aligned on the side of the pin which faces inward radially towards the air guide opening. This increases the stability of the air guide.

The concept of aspects of the present invention can be realized in a particularly advantageous manner by means of one or more of the conFIG.urations named above, if the air guide is formed from plastic. A plastic air guide can be manufactured in a comparatively simple manner as a compression molded or blow molded part, or as a cast part.

Embodiments of the invention are described below with reference to the illustrations. The drawings are not necessarily intended to show the embodiments to scale, but rather the drawings are shown in a schematic and/or mildly distorted form where it is helpful for explication. Regarding expansion of the teaching which is directly recognizable in the illustration, attention is directed to the relevant prior art. It should be noted that numerous modifications and alterations to the form and the details of an embodiment can be undertaken, without deviating from the general idea of the invention. The features of the invention disclosed in the specification, in the illustrations, and in the claims can be essential for the advantageous effect of the invention, both individually and in combination. In addition, all combinations of at least two of the features disclosed in the specification, in the illustrations, and/or in the claims fall within the scope of the invention. The general idea of the invention is not restricted to the exact form or to the details of the preferred embodiment shown and described below, nor restricted to a subject matter which would be restricted in comparison to the subject matter claimed in the claims. In cases where measurement ranges are given, values which lie within the named boundaries are also hereby disclosed, and can be used and claimed in any way. For reasons of simplicity, reference numbers which are used in the following for similar parts, or for parts having identical or similar functions, are the same.

BRIEF DESCRIPTION OF THE FIGURES

Additional advantages, features, and details of the invention will become apparent from the following description of the preferred embodiments when considered with the attached drawings and appended claims. The following illustrations are included:

DETAILED DESCRIPTION OF THE INVENTION

Figure 1:
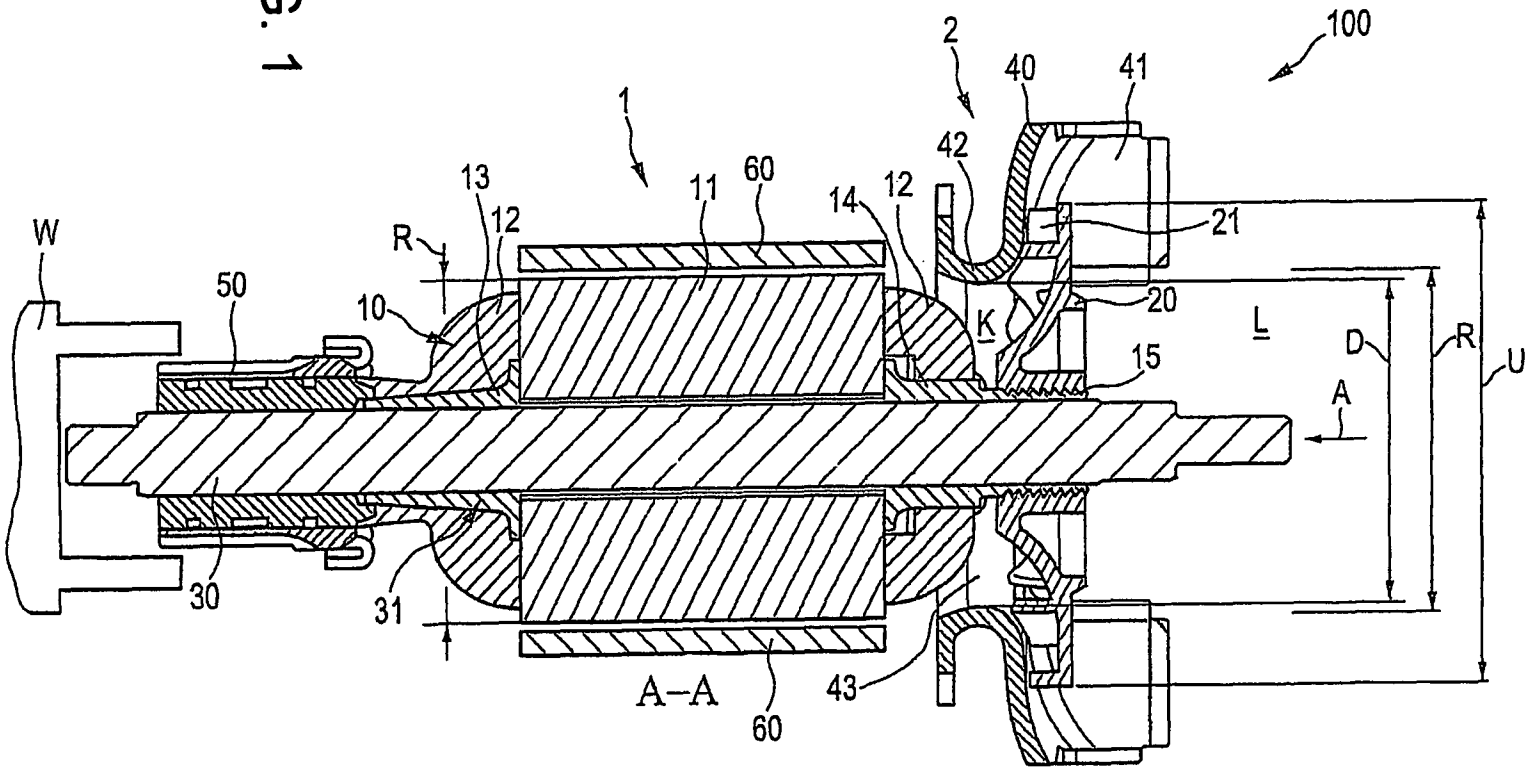
FIG. 1 shows a sectional view A-A of a system consisting of an electric motor and a fan according to a particularly preferred embodiment of the present invention, wherein the stator is not shown in detail.
Figure 2:
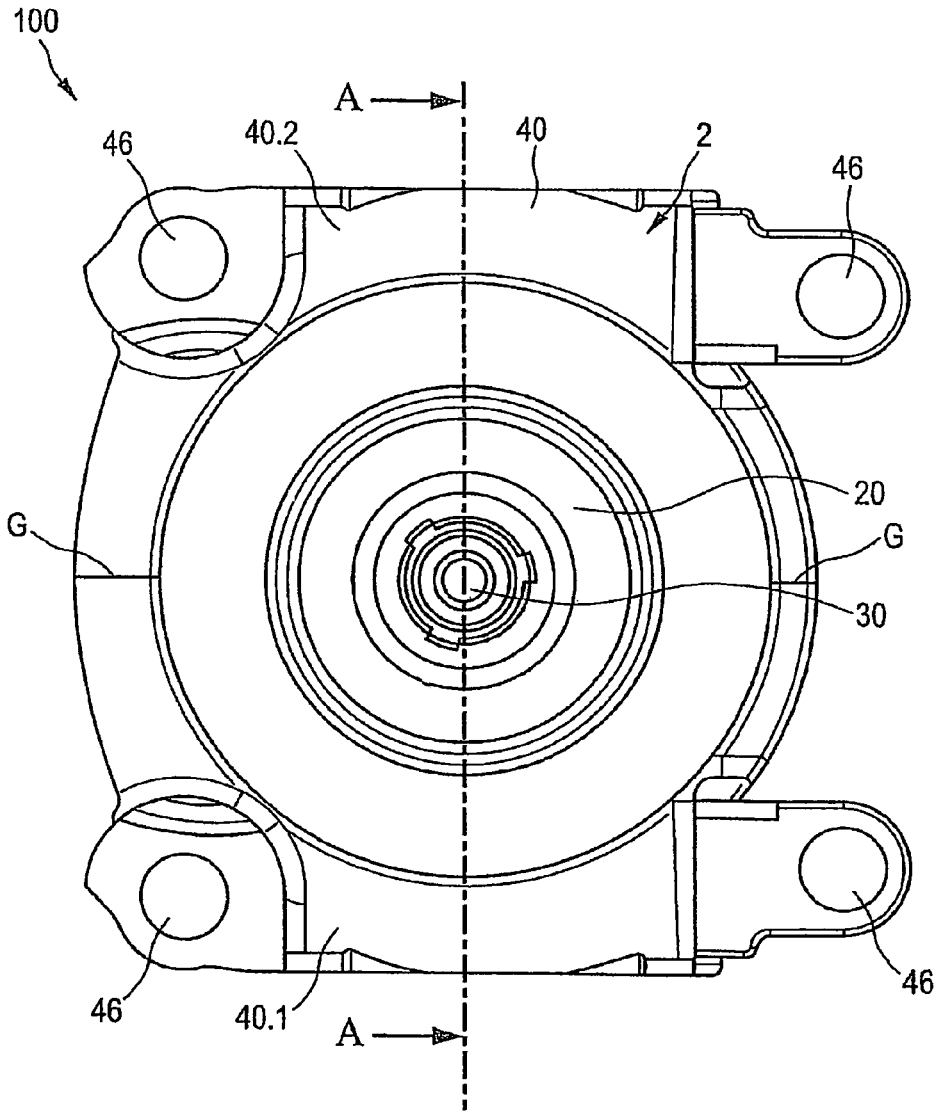
FIG. 2 shows a front view of the system shown in FIG. 1, from the side having the fan, wherein the plane A-A where the sectional cut is made in FIG. 1 has been made visible.

FIG. 1 shows a sectional view along the cut A-A of the fan-side view shown in FIG. 2, including a system 100 made up of an electric motor 1 and a fan 2. The present electric motor 1 with stator 60, which is symbolically illustrated, has a rotor pack, which is indicated as the rotor 10 for reasons of simplicity, wherein the anchor and the anchor windings 11, as well as the mountings 12, are symbolically illustrated. The rotor 10 can be driven in a rotating manner via a magnetic interaction occurring between the stator 60 and the rotor 10. The rotor 10 is rigidly affixed to a shaft 30 via rotor connection segments 13, 14 of a ferrule connector 15, wherein each of the same are attached to the mounting 12, and wherein said shaft is driven in a rotating manner by the rotor 10. The shaft 30 has a coupling 50 on the drive side thereof, and a machine can be driven by means of said coupling 50—which is primarily illustrated in a symbolic manner as machine tool W. In principle, the system 100 illustrated here is also suitable for driving other machines. A flywheel 20 is rigidly fixed to the shaft 30 on the fan side thereof via a flywheel connection segment 15 of the ferrule connector 31. Both the rotor 10 and the flywheel 20 rotate with the shaft 30.

In a method for the production thereof, the assembly component formed by the rotor 10, the fan 20, and the shaft 30—optionally with the coupling 50, is provided, so that the air guide 40 can be mounted on the same, wherein said air guide 40 is designed in the manner of a housing for the flywheel 20. The air guide 40 has a housing area 41 and a blowing channel area 42. The flywheel 20 is received in the housing area 41. The flywheel 20 generates an air flow in the axial direction A via the vanes 21 attached to the flywheel 20, thereby conveying cool air L substantially as axial flow into the blowing channel K. The fan 2 is designed in the present case as an axial fan. In an embodiment not shown here, a radial fan can also be provided, wherein a housing sucks in cool air as a radial flow. The present axial blowing channel K is formed by an air guide opening 43, the same being constructed in the blowing channel segment 42. Accordingly, the blowing channel K has the inner cross section of the air guide opening 43, which corresponds substantially to the unobstructed inner width of the air guide opening 43. The inner cross section of the air guide opening 43, so defined, has the inner diameter D as illustrated. The inner diameter D is smaller than an outer diameter R of the rotor pack, this being indicated as the rotor 10. The outer diameter U of the flywheel 20 is likewise illustrated in FIG. 1. Although the inner cross section and/or inner diameter D of the air guide opening 43 is consequently smaller than the outer cross section and/or outer diameter R of the rotor 10, and consequently the air guide 40 cannot slide over the rotor 10, the air guide 40—according to the concept of aspects of the present invention—is mounted in a particularly advantageous manner on the assembly component made up of the rotor 10, shaft 30, and the flywheel 20.

FIG. 2 shows the front view of the system 100 on the side of the fan, said system having the shaft 30, the flywheel 20, and the air guide 40. The air guide 40 is constructed as a two-piece part which is assembled together, as can be seen in FIG. 2, wherein said two-piece part has a first part 40.1 and a second part 40.2. The first and the second part 40.1, 40.2 abut each other along a boundary line G which transects the inner cross section of the air guide opening 43. In the illustrated embodiment, the boundary line G runs substantially along the diameter D of the inner cross section.

The fan 2, which can also be characterized as an axial fan, has a suitable number of eyelets 46 in the housing area 41 of the air guide 40, which function as a suitable holding means for the fan 2 in the system 100.

Figure 3:
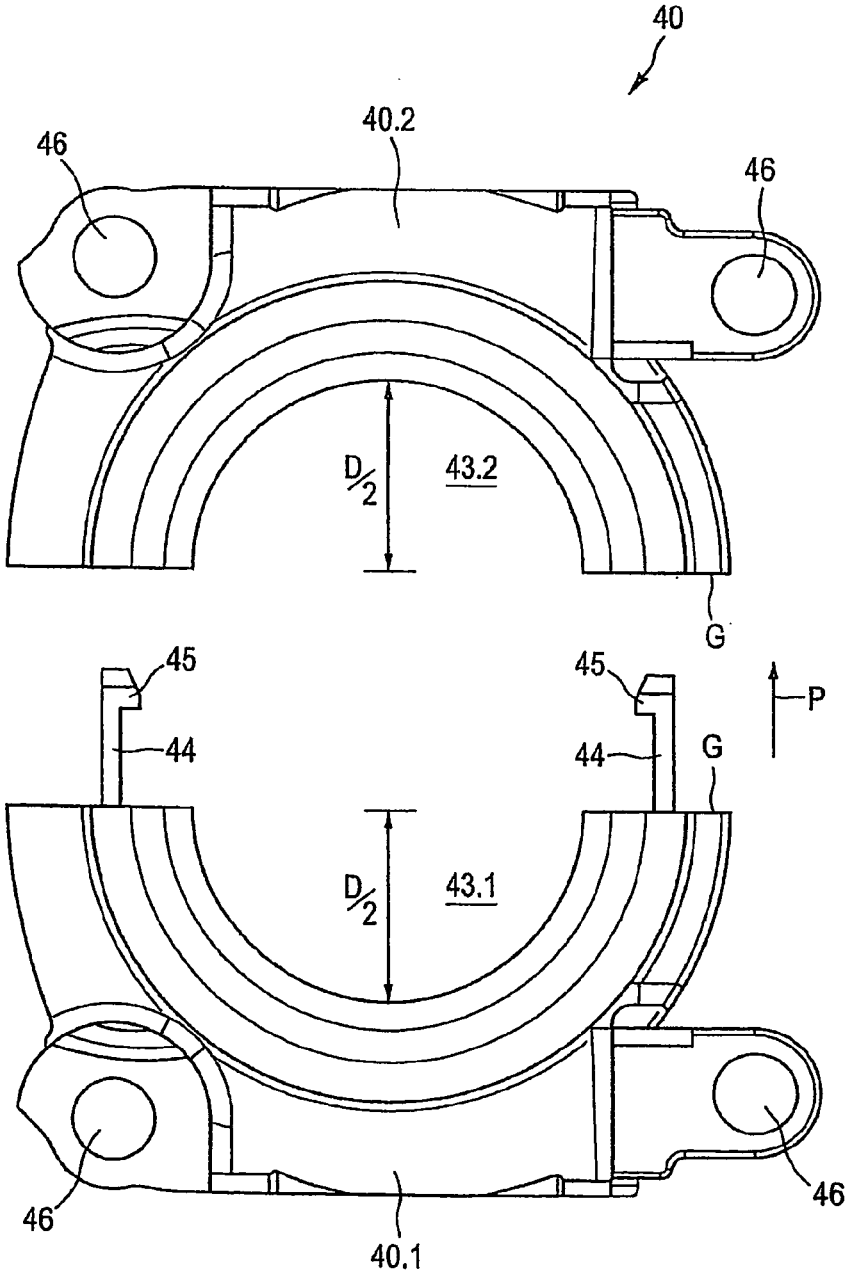
FIG. 3 shows an extrapolation illustration of an air guide for use in the system in FIG. 1 and FIG. 2, wherein the same can be assembled from two pieces, the first and the second part.

The two-piece part of the air guide 40 is once more illustrated in FIG. 3 in an extrapolation drawing, along with the first part 40.1 and the second part 40.2. The edge of the otherwise curved—and in the illustrated embodiments crescent-shaped—body of the first and the second part 40.1, 40.2, said edge corresponding to the boundary line G, is visible therein. The first and the second part 40.1, 40.2 each has, in the illustrated embodiments, an exactly crescent-shaped recess 43.1 and/or 43.2 on an additional inner curved edge thereof. The recesses 43.1, 43.2 substantially form the air guide opening 43 when in the assembled state. The radius of the crescent-shaped recess 43.1 and/or 43.2 therefore corresponds to D/2, that is, to half of the inner diameter D of the air guide opening 43.

During the manufacturing process, the first and second parts 40.1, 40.2 are positioned on opposite sides of the assembly component made up of the rotor 10, the shaft 30, and the flywheel 20 at a position between the flywheel 20 and the rotor 10 with respect to the axial direction, and are then put together abutting each other in the direction of the arrow P, such that the two-part air guide 40 in FIG. 2 is formed.

The first part 40.1 has a pin 44, which is designed in a spring-loaded manner, on each end of its curved body, wherein said pin 44 has a catch 45 which faces inward radially—meaning toward the air guide opening 43. When the first and second part 40.1, 40.2 are put together in the direction of the arrow P, the pin 44 engages with a suitable pin recess in the second part 40.2 lying opposite the pin 44, and the catch 45 snaps into a catch recess in the rearward part of said pin recess. In this way, the parts 40.1, 40.2 can be put together in a comparatively simple manner, and fixed to each other with a snap connection.

As a result, an inner diameter D of the air guide opening 43 is then formed, this being smaller than the outer diameter R of the rotor 10. In the illustrated embodiment, the air guide 40 is likewise formed as a plastic press molded part like the flywheel 20.

The invention claimed is:

1. A fan according having an air guide and a flywheel, the flywheel attached to a shaft, for cooling an electric motor, the electric motor having a rotor attached to the shaft, wherein the air guide is arranged in a position between the flywheel and the rotor with respect to the axial direction, the air guide having an air guide opening including an inner cross section for forming a blowing channel, wherein an air flow generated by the flywheel can be guided in the axial direction, wherein the inner cross section of the air guide opening is smaller than the outer cross section of the rotor, wherein the air guide is formed as a part which can be assembled from at least two parts, such that the part has at least a first and a second part, the first and the second part abutting each other along a boundary line which transects the inner cross section of the air guide opening.

2. A fan according to claim 1 wherein the boundary line runs along a diameter of the inner cross section.

3. A fan according to claim 1 wherein the boundary line runs along a secant of the inner cross section.

4. A fan according to claim 1 wherein the boundary line is longer than a diameter of the shaft in the area where the boundary line transects the inner cross section.

5. A fan according to claim 1, wherein a blow parameter of the blowing channel is defined as the product of an inner diameter of the inner cross section and a free gap between the air guide and the flywheel, and a boundary parameter is defined as the product of an outer diameter of the rotor and a prespecified minimum free gap between the air guide and the flywheel, wherein the blow parameter is smaller than or equal to the boundary parameter.

6. A fan according to claim 1 wherein the first and the second part are connected to each other by means of a pinned joint.

7. A fan according to claim 1, wherein the air guide is made of plastic.

8. An electric motor assembly including a stator a rotor and a fan, the rotor attached to a shaft, the fan including an air guide and a flywheel, the flywheel attached to the shaft for cooling the electric motor assembly, the air guide formed as a multiple-piece assembly that is configured to be joined around the shaft in a position between the flywheel and the rotor with respect to an axial direction, the air guide including an air guide opening extending around the shaft and including an inner cross section for forming a blowing channel, wherein an air flow generated by the flywheel can be guided through the blowing channel in the axial direction, wherein the inner cross section of the air guide opening is smaller than an outer diameter of the rotor.

9. The electric motor assembly of claim 8 further including a machine tool, the machine tool being driven by the electric motor assembly.

10. A method for the production of an electric motor assembly having a stator, a rotor, and a fan, the stator and the rotor attached to a shaft, the fan including an air guide and a flywheel, the flywheel attached to the shaft for cooling the electric motor, the method including the steps of:

providing an assembly component made up of the rotor attached to the shaft and the flywheel attached to the shaft;

providing the air guide as a part which can be assembled from at least two pieces, wherein the part includes at least a first and a second part, wherein the first and the second parts are bounded along a boundary line which transects an inner cross section of the air guide opening;

interchangeably arranging the air guide on the assembly component in a position between the flywheel and the rotor with respect to the axial direction, wherein the at least first and second part are arranged in an interchangeable manner between the flywheel and the rotor with respect to the axial direction; and fitting together the first and the second parts to abut each other, thereby forming the air guide opening with the inner cross section for forming a blowing channel, wherein an air flow generated by the flywheel can be guided through the blowing channel in the axial direction, wherein the inner cross section is smaller than an outer cross section of the rotor.

* * * * *